United States Patent [19]

Löffler

[11] Patent Number: 5,063,629

[45] Date of Patent: Nov. 12, 1991

[54] HEEL SUPPORT DEVICE WITH REDUCED MOVEMENT OF SUPPORT

[75] Inventor: Tilo Löffler, Pirmasens, Fed. Rep. of Germany

[73] Assignee: Schön & Cie. AG, Pirmasens, Fed. Rep. of Germany

[21] Appl. No.: 473,157

[22] Filed: Jan. 31, 1990

[30] Foreign Application Priority Data

Jan. 31, 1989 [DE] Fed. Rep. of Germany ..... 3902737

[51] Int. Cl.[5] ..... A43D 21/00

[52] U.S. Cl. ..... 12/12.4; 12/123

[58] Field of Search ..... 12/12.2, 12.4, 12, 123

[56] References Cited

U.S. PATENT DOCUMENTS

| | | | |
|---|---|---|---|
| 4,627,124 | 12/1986 | Winter | 12/12.4 |
| 4,653,133 | 3/1987 | Giebel | 12/12.4 X |
| 4,777,685 | 10/1988 | Giebel et al. | 12/12.4 X |
| 4,833,749 | 5/1989 | Loffler et al. | 12/12.4 |

FOREIGN PATENT DOCUMENTS

| | | | |
|---|---|---|---|
| 0100636 | 2/1984 | European Pat. Off. | 12/12.2 |
| WO87/05476 | 9/1987 | World Int. Prop. O. . | |

*Primary Examiner*—Paul T. Sewell
*Assistant Examiner*—BethAnne C. Cicconi
*Attorney, Agent, or Firm*—Wenderoth, Lind & Ponack

[57] ABSTRACT

A heel support device for use in a shoe making machine for lasting the toe and sides of a shoe upper tensioned over a last seated on a last support includes a heel support movable along a fixed guide of the machine. A drive moves the heel support along the guide in a first direction from an unloading position spaced from the last to a supporting position in contact with and supporting a heel portion of the upper tensioned about the last. After completion of a lasting operation, the drive moves the heel support along the guide in an opposite second direction to return the heel support to the unloading position. The completed last and lasted upper then are removed from the last support and a new last and upper are positioned theron for a subsequent lasting cycle. Upon the completion of one lasting cycle, the distance of movement of the heel support in the first direction required to reach the supporting position for the new last and upper of the subsequent lasting cycle is reduced by the provision of a device, operatively connected to the drive, to cause the drive to move the heel support in the first direction from the unloading position to a preselected loading position between the unloading position and the supporting position required for the subsequent lasting cycle.

6 Claims, 1 Drawing Sheet

HEEL SUPPORT DEVICE WITH REDUCED MOVEMENT OF SUPPORT

BACKGROUND OF THE INVENTION

The present invention relates to a heel support device for use in a shoe making or lasting machine for forming or lasting the toe and sides of a shoe upper that is tensioned over a last seated or resting on a last support. In this type of device, a heel support or heel support member is movable along a guide that is fixed to and stable with the machine. This movement is achieved by a drive that moves the heel support along the guide in a first direction from an unloading position that is spaced from the last to a supporting position in contact with and supporting a heel portion of the upper that is tensioned about the last. After completion of a lasting operation, the drive moves the heel support along the guide in an opposite second direction to return the heel support to the unloading position. At such time, the last and the lasted upper are removed from the last support and a new last and upper to be lasted are positioned on the last support for a subsequent or new lasting cycle.

There is disclosed in U.S. Pat. No. 4,833,749 a lasting machine having a heel support located at the start of the lasting cycle at a distant, spaced unloading position that corresponds to the maximum possible distance of the heel support from the heel end of the last and in which a previously lasted unit can be removed from the last support, for example by falling into a tray located beneath the last support. To conduct a subsequent lasting operation or cycle, the heel support is moved from the unloading position into a contact position at the heel of the last, or the upper tensioned thereon, that is newly positioned on the last support. This operation is achieved by an operator via a control mechanism. Following the completion of the lasting operation or cycle, the heel support is returned to the unloading position to allow the lasted unit, i.e. the last and lasted upper, to be removed from the last support, i.e. to drop into the tray. The distance of movement of the heel support between the unloading and contact or supporting positions is set to be the maximum required for the largest possible size last employed by the machine. One disadvantage of this system is that, particularly when lasting smaller or shorter shoe units, the heel support must travel a relatively long distance from the unloading position to the supporting position. This substantial travel distance takes time, and this time is wasted and thus reduces the productivity of a mass production operation.

It is known to provide, such as disclosed in WO 87/05476 A, a machine for reconditioning and lasting the toe of a shoe upper wherein the heel support has a plurality of preselected "next starting positions". In this system an operator selects a particular such "next starting position", for example by means of a dial or other selector mechanism, and this is based on the particular size of the next unit to be lasted. In this system, the operator always must be careful to observe that the correct next starting position that is chosen is correct for the unit located on the last support. This inherently occasionally results in difficulties when the operator incorrectly chooses the next start position.

SUMMARY OF THE INVENTION

Accordingly, it is an object of the present invention to provide a heel support device whereby it is possible to overcome the above and other prior art disadvantages.

It is a further object of the present invention to provide such a heel support device of improved speed of operation and efficiency, as well as reliability of operation.

These objects are achieved in accordance with the present invention by the provision of means for, upon the completion of one lasting cycle, reducing the distance of movement of the heel support in the first direction from the unloading position required to reach the supporting position required for a new last and upper of a subsequent lasting cycle. This is achieved by control means, operatively connected to the drive, for causing the drive to move the heel support in the first direction from the unloading position to a preselected or preselectable loading position between the unloading position and the supporting position required for the subsequent lasting cycle. The loading position is determined automatically and is sufficiently close to the supporting position required for the subsequent lasting cycle that the necessary further movement of the heel support from such preselected loading position, once the new last and upper are positioned on the last support, is a minimum. In other words, once a new last unit is positioned on the last support, the heel support thereafter will be caused to travel only the shortest possible distance from the loading position to the supporting position. The loading position always is as close as possible to the last heel of the new last unit, while still ensuring that positioning of the new last unit on the last support can be achieved conveniently.

In accordance with one feature of the present invention, the loading position of a new lasting cycle is determined as a function of the size of the last employed in the previous lasting cycle. In accordance with a particularly preferred arrangement of the present invention, such loading position of a new lasting cycle is determined as a function of the supporting position of the heel support in the previous lasting cycle. In this manner, it is possible to ensure that during automated production of shoes of the same size, the heel support always is moved into the same and correct loading position, thereby making it possible to increase production efficiency by saving time required for movement of the heel support. Thus, the loading position can be determined as a function of an assumed or programmed supporting position of the heel support in the previous lasting cycle.

The distance from the unloading position to a determined loading position for a new lasting cycle may be computed as a function of the supporting position of the heel support in the previous lasting cycle, and in this manner it is possible to ensure control of production automatically and with a high degree of reliability. As determined by requirements for manufacture of different types and sizes of shoes, the distance from the unloading position to a particular loading position may be computed logically from a previous supporting position of a previous lasting cycle of a shoe of the same size and/or same style.

The drive that controls movement of the heel support can be actuated by an automatically operable control means responsive to various detected parameters, for example detection of the supporting position in a previous lasting cycle, the distance moved by the heel support from the supporting position of the previous lasting cycle to the unloading position, etc. Furthermore, it is possible to provide a manually operable control connected to the drive for selectively operating the drive to move the heel support to a manually determined position. For example, when the previous lasting cycle employed a last of substantially smaller size than for a subsequent lasting cycle, then determining the loading position for the subsequent lasting cycle based on the supporting position in the previous lasting cycle may result in the heel support being too close to the last, i.e. too far away from the unloading position. In such a situation, for example contemplated when making a substantial size or style change, then the manually operable control may be employed to operate the drive to move the heel support back to the unloading position and/or to a manually determined loading position suitable for the new size or style. Such manually operable control of course also could be employed to maintain production in the event of failure of the automatically operable control.

The automatically operable control may include means for detecting the supporting position of the heel support in the previous lasting cycle and means for determining the loading position of the subsequent lasting cycle in response to such detection. Also, the automatically operable control may include means for measuring the distance moved by the heel support in the second direction from the supporting position of the heel support in the previous lasting cycle to the unloading position, and means operable in response to such measurement for computing, calculating or determining the distance of movement of the heel support from the unloading position to the preselected or predetermined loading position of the subsequent lasting cycle.

BRIEF DESCRIPTION OF THE DRAWINGS

Other objects, features and advantages of the present invention will be apparent from the following description of a preferred embodiment, taken with the accompanying drawings, wherein.

DETAILED DESCRIPTION OF THE INVENTION

Figure 1:
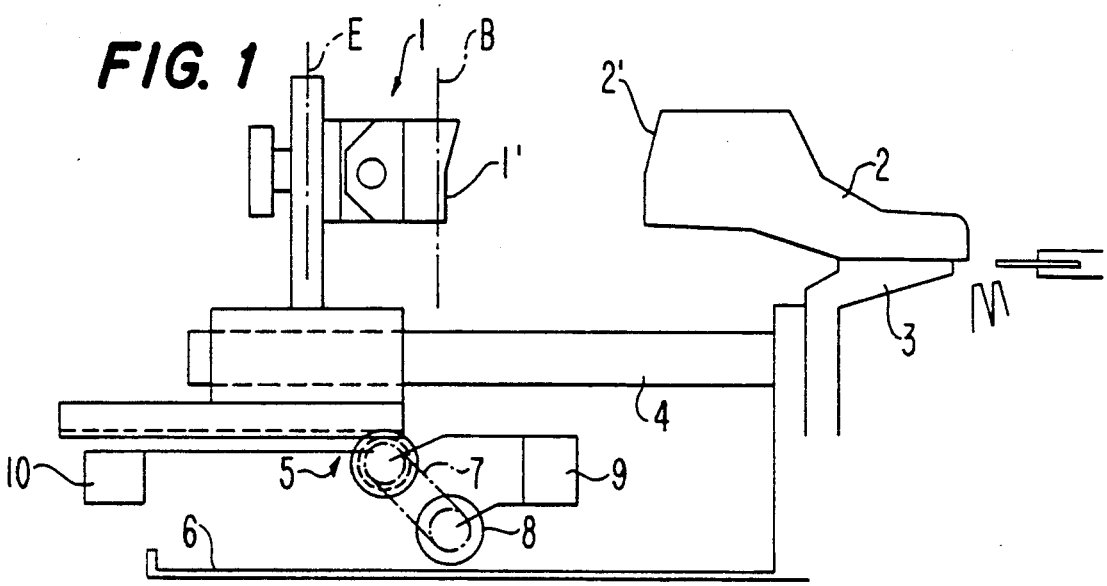
FIG. 1 is a schematic view of a heel supporting device in accordance with the present invention, shown in cooperation with a portion of a shoe lasting machine, with a heel support of the device being shown in an unloaded position.
Figure 3:
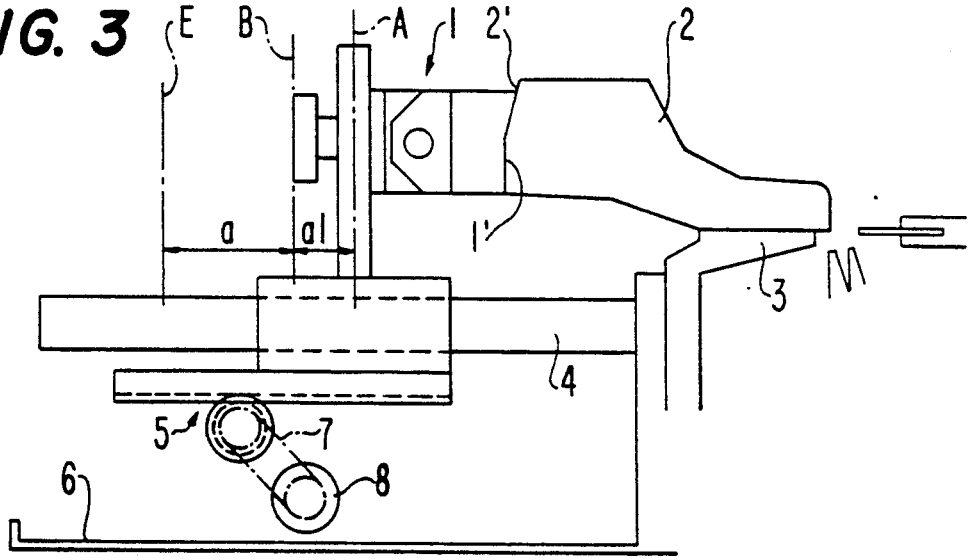
FIG. 3 is a view similar to FIGS. 1 and 2, but showing the heel support in a supporting position in contact with a last or an upper tensioned therearound.

In the drawings there is shown schematically a portion only of a shoe lasting machine and including a last support 3 for supporting a last 2 having tensioned therearound a shoe upper (not shown). The machine also includes a fixed or stable guide 4 along which is moved a heel support 1, such movement being achieved by a drive mechanism 5. These elements in and of themselves are conventional and are operated in the following manner. Thus, with the heel support 1 in an unloading position E, a last 2 and an upper are positioned on last support 3, as shown in FIG. 1. Drive mechanism 5 then moves heel support 1 to a contact position A, as shown in FIG. 3, wherein a contact portion 1' of heel support 1 abuts a heel portion 2' of the last (or more properly a heel portion of the upper tensioned therearound). In such position, the lasting machine lasts the toe and sides of the upper to complete a lasting cycle. Thereafter, the drive mechanism 5 returns the heel support 1 to the unloading position E, thereby allowing the lasted upper and last to be removed from last support 3, for example by dropping downwardly to a tray 6.

The above basic operations are conducted and controlled automatically in a known manner and by known mechanisms not illustrated herein inasmuch as they are conventional. One skilled in the art readily would understand how the above described mechanisms would be controlled to operate in the above described manner.

However, if the size of last employed in a particular lasting cycle is quite small, then the movement of the heel support 1 from the unloading position E to the supporting position A will be quite large. A substantial portion of this movement is lost time that disadvantageously effects productivity of the machine.

Figure 2:
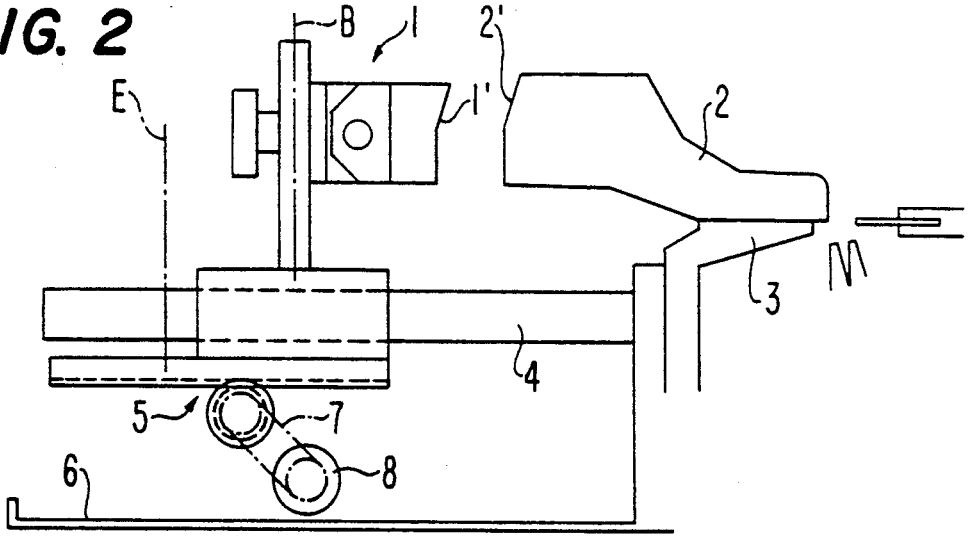
FIG. 2 is a view similar to FIG. 1, but showing the heel support in a loading position.

Therefore, in accordance with the present invention there is provided means for, upon the completion of one lasting cycle, reducing the distance of movement of heel support 1 from the unloading position E to the supporting position A required for a new last and upper of a subsequent lasting cycle. Particularly, the present invention provides means, operatively connected to drive mechanism 5, for causing drive mechanism 5 to move heel support 1 from unloading position E to a predetermined or preselected or preselectable loading position B (FIG. 2) between unloading position E and supporting position A required for the subsequent lasting cycle. This movement is carried out automatically and immediately after return of the heel support 1 from the supporting position of the previous lasting cycle to the unloading position E. As a result, when the new last and upper for the subsequent lasting cycle then are positioned on last support 3, the drive mechanism 5 automatically is operated to move heel support 1 from loading position B to the supporting position A required for the subsequent lasting cycle. The distance of this movement is less than the distance required for movement from unloading position E. The loading position B selected for a given lasting cycle will be as close as possible to the supporting position A for such subsequent lasting cycle, and of course will be sufficient to enable the new last and upper to be positioned on last support 3.

In one particularly preferred embodiment of the present invention, there is provided an automatically operable control arrangement for determining the loading position B for a subsequent lasting cycle. Such arrangement includes a distance detector 8, for example a digital transmitter, operatively connected to drive mechanism 5 for measuring the distance of movement of heel support 1 from a previous supporting position A to unloading position E. Such measured distance then is employed, for example by means of a controller 9, to cause drive mechanism 5 to move heel support 1 to a predetermined or computed or calculated loading position B suitable for a subsequent lasting operation. Device 9 may be a suitable programmed memory unit to control position B as a function of the distance measured by mechanism 8. This arrangement is shown only schematically in FIG. 1 and is not shown in the other figures for simplicity of illustration. Furthermore, this arrangement is intended to be of conventional components that readily would be understood by one skilled in the art from the present disclosure. Such control could be of conventional circuitry or chips that could be adapted to achieve the functions described herein in manners well understood by those skilled in the art.

The movement of drive from mechanism 5 may be transmitted to mechanism 8 via a gear belt arrangement. Also, in the illustrated arrangement drive mechanism 5 is a drive motor operating a rack and pinion arrangement in cooperation with heel support 1. Those skilled in the art readily would understand that other drive arrangements as well as control arrangements in addition to those described and illustrated could be employed to achieve the functions described herein. For example, the automatically operable control could include means for detecting the supporting position A of heel support 1 in a previous lasting cycle, and means 9 could employ such detection to control operation of drive mechanism 5 to move heel support 1 from the unloading position E to a predetermined or calculated loading position B that thus is determined as a function of the previous supporting position A.

It is conventional in the art to last a plurality of lasts of the same size or of sizes that differ from each other progressively. This may be programmed into the automatically operable control to calculate a sequence of predetermined loading positions B. It is of course possible that other sequences could be programmed to operate the above described variations of the automatically operable control.

In accordance with a further feature of the present invention, there is provided a manually operable control 10 connected to drive mechanism 5 for selectively operating mechanism 5 to move heel support 1 to a manually determined loading position B. This would be useful upon breakdown of automatically operable control 9, or during other operating occurrences, for example when the size of the last for a subsequent cycle is substantially different than the size of the last in a previous cycle, etc., as would be understood by one skilled in the art from the present disclosure.

It further is to be understood that mechanism 8 could be of various different types than the specifically above discussed digital transmitter, for example an analog transmitter or other detecting or measuring device.

Although the present invention has been described and illustrated with respect to preferred features, it is to be understood that various modifications and changes to the specifically described and illustrated features may be made without departing from the scope of the present invention.

I claim:

1. In a heel support device for use in a shoe making machine for conducting a plurality of successive lasting cycles each including lasting a toe and sides of a shoe upper tensioned over a last seated on a last support, said heel support device including a heel support to be movable along a fixed guide of the machine, and drive means for moving said heel support along the guide in a first direction from an unloading position to be spaced from the last to a supporting position to be in contact with and supporting a heel portion of the upper tensioned about the last and, after completion of lasting, moving said heel support along the guide in an opposite second direction to return said heel support to said unloading position, whereupon such last and lasted upper are removed from the last support and a new last and upper to be lasted are positioned thereon for a subsequent lasting cycle, the improvement of means for, upon completion of one lasting cycle, reducing the distance of movement of said heel support in said first direction required to reach said supporting position for the new last and upper of the subsequent lasting cycle, said reducing means comprising:

means, operatively connected to said drive means, for causing said drive means to move said heel support in said first direction from said unloading position to a loading position between said unloading position and the said supporting position required for the said subsequent lasting cycle, such that when the new last and upper for the said subsequent lasting cycle then are positioned on the last support said drive means is operated to move said heel support in said first direction from said loading position to the said supporting position required for the said subsequent lasting cycle, said causing means comprising automatically operable control means for determining said loading position as a function of the said supporting position of said heel support in a previous lasting cycle; and the improvement further comprising manually operable control means, operatively connected to said drive means, for selectively moving said heel support to a manually determined said loading position.

2. The improvement claimed in claim 1, wherein said control means is operable to determine said loading position on the basis of the size of the last in the previous lasting cycle.

3. The improvement claimed in claim 1, wherein said causing means is operable to determine said loading position on the basis of an assumed said supporting position of said heel support in the previous lasting cycle.

4. The improvement claimed in claim 1, wherein said causing means further includes means for computing the distance from said unloading position to said loading position as a function of said supporting position of said heel support in the previous lasting cycle.

5. The improvement claimed in claim 1, wherein said automatically operable control means includes means for detecting the said supporting position of said heel support in the previous lasting cycle, and means for determining said loading position for said subsequent lasting cycle in response to such detection.

6. The improvement claimed in claim 1, wherein said automatically operable control means comprises means for measuring a distance moved by said heel support in said second direction from the said supporting position of said heel support in the previous lasting cycle to said unloading position, and means, operable in response to such measurement, for calculating a distance of movement of said heel support from said unloading position to said loading position.

* * * * *